United States Patent [19]

Saunders

[11] 4,120,419

[45] Oct. 17, 1978

[54] HIGH STRENGTH SEAMLESS CHIME CAN BODY, SHEET METAL CONTAINER FOR VACUUM PACKS, AND MANUFACTURE

[75] Inventor: William T. Saunders, Weirton, W. Va.

[73] Assignee: National Steel Corporation, Pittsburgh, Pa.

[21] Appl. No.: 659,995

[22] Filed: Feb. 23, 1976

[51] Int. Cl.[2] ..... B65D 7/42

[52] U.S. Cl. ..... 220/66; 220/1 BC; 220/74

[58] Field of Search ..... 220/66, 1 BC, 74, 83, 220/72, 70; 215/1 C; 113/120 H

[56] References Cited

U.S. PATENT DOCUMENTS

| | | | |
|---|---|---|---|
| 1,461,729 | 7/1923 | Foster et al. | 228/149 |
| 1,839,272 | 1/1932 | Sinko | 113/120 H |
| 2,142,743 | 1/1939 | Calleson et al. | 220/60 |
| 2,339,763 | 1/1944 | Calleson et al. | 113/120 |
| 3,057,537 | 10/1962 | Pollick | 220/66 X |
| 3,297,194 | 1/1967 | Schaper et al. | 220/72 |
| 3,315,839 | 4/1967 | Catalano et al. | 220/72 X |
| 3,416,702 | 12/1968 | Hoenig | 220/70 |
| 3,610,018 | 10/1971 | Swanson et al. | 113/120 H X |
| 3,690,507 | 9/1972 | Gailus et al. | 220/66 |
| 3,905,507 | 9/1975 | Lyu | 220/66 |
| 3,907,152 | 9/1975 | Wessely | 220/66 |
| 3,912,109 | 10/1975 | Essex, Jr. et al. | 220/66 |
| 3,951,296 | 4/1976 | Swanson et al. | 113/120 H X |

*Primary Examiner*—William Price
*Assistant Examiner*—Steven M. Pollard
*Attorney, Agent, or Firm*—Shanley, O'Neil and Baker

[57] ABSTRACT

In the manufacture of unitary sheet metal can bodies for vacuum-pack two-piece sanitary cans, a high-strength seamless chime is formed at the juncture of the sidewall and unitary endwall of the can body. The seamless chime comprises longitudinally oriented outer, intermediate, and inner wall portions which define outer and inner circular channels about a peripheral portion of the unitary endwall. The remaining endwall panel, with reinforcing profile rings, extends substantially laterally from the inner wall portion of the seamless chime. The endwall panel can flex longitudinally under interval vacuum and pressure conditions without permanent distortion (implosive or bulging) of the can body sheet metal. A radially extended bead is roll formed in the sidewall contiguous to the seamless chime; the diameter of such bead is selected to compensate for the added diameter of a closure seam at the open end of the can body. The can sidewall is strengthened by reinforcing ribs rolled in the sidewall intermediate its longitudinal ends.

3 Claims, 5 Drawing Figures

FIG. 1 PRIOR ART
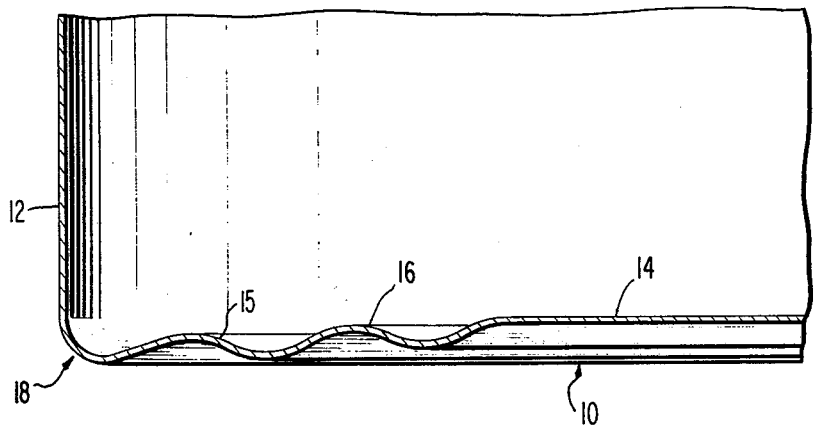
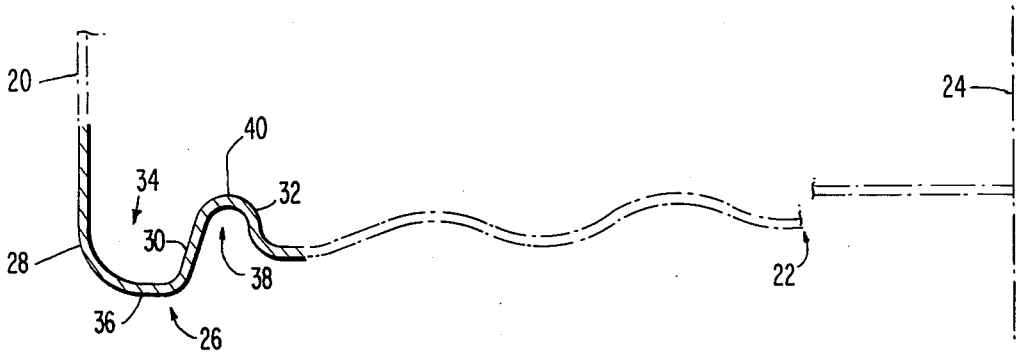
FIG. 2
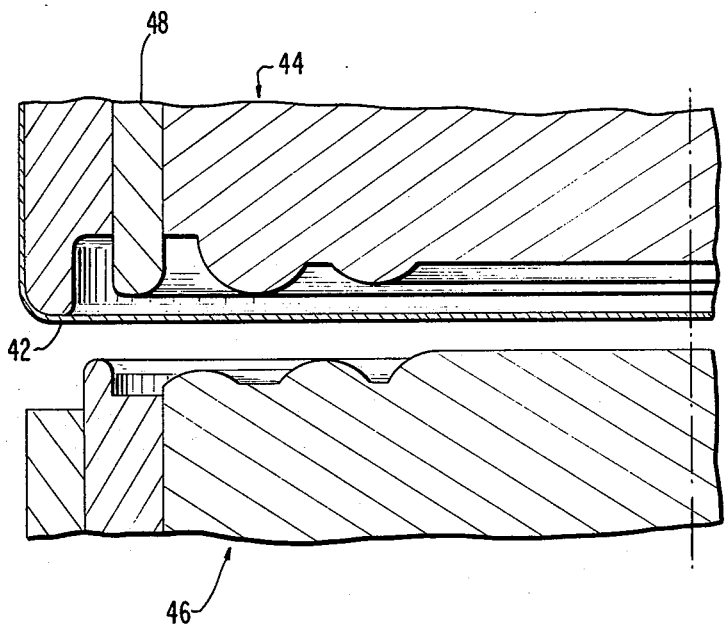
FIG. 3

HIGH STRENGTH SEAMLESS CHIME CAN BODY, SHEET METAL CONTAINER FOR VACUUM PACKS, AND MANUFACTURE

This invention is concerned with can manufacture. In its more specific aspects, the invention is concerned with a seamless can body having a chime juncture providing for flexing of its unitary endwall without permanent distortion of the can body sheet metal.

Sheet metal containers used for packing vegetables, fruits, and similar foods are required to withstand, at differing times, internal vacuum or internal pressure. Such foodstuffs are ordinarily packed and sealed under vacuum conditions. Thereafter internal pressure results from heat treatment, such as pasturizing, or other high temperature conditions applied prior to opening.

In the past such sanitary cans have generally been manufactured from three pieces of sheet metal including a longitudinally extending seamed sidewall with an endwall double-seamed to the sidewall at each of its longitudinal ends. The conventional three-piece sanitary can is made from tinplated steel; the endwall gage is ordinarily between 0.007 inch (0.178 mm) and about 0.010 inch (0.254 mm) and the sidewall has a gage generally between 0.0066 inch (0.168 mm) and 0.009inch (0.229 mm). Both endwall and sidewall gages can vary dependent on the can size and the container contents. Three pieces of sheet metal have to be cut and handled. In addition, the sidewall seam and two chime seaming operations required are significant cost factors in the manufacture of three-piece cans.

Use of a two-piece can, that is a seamless can body and single endwall closure, eliminates the bottom chime seam and the longitudinally extending sidewall seam. However, commercial use of the seamless can body has generally been limited to low-vacuum, shallow-depth (about 1½inches (3.5 cm)) container uses, e.g. for solid pack contents. Without the high-strength, double-seamed bottom chime of the three-piece container it is difficult to avoid either implosion or endwall bulging near the seam-free chime of a two-piece container under the relatively high vacuum and pressure conditions encountered with standard sized sanitary can packs. There is also a problem of denting at the bottom chime area with normal handling.

The present invention provides a unitary can body with a strengthened seamless chime juncture which makes manufacture of a two-piece sanitary can practicable and economical.

Figure 4:
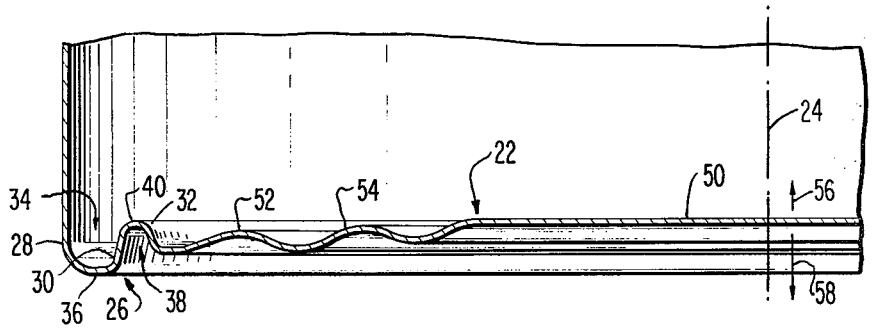
Figure 5:
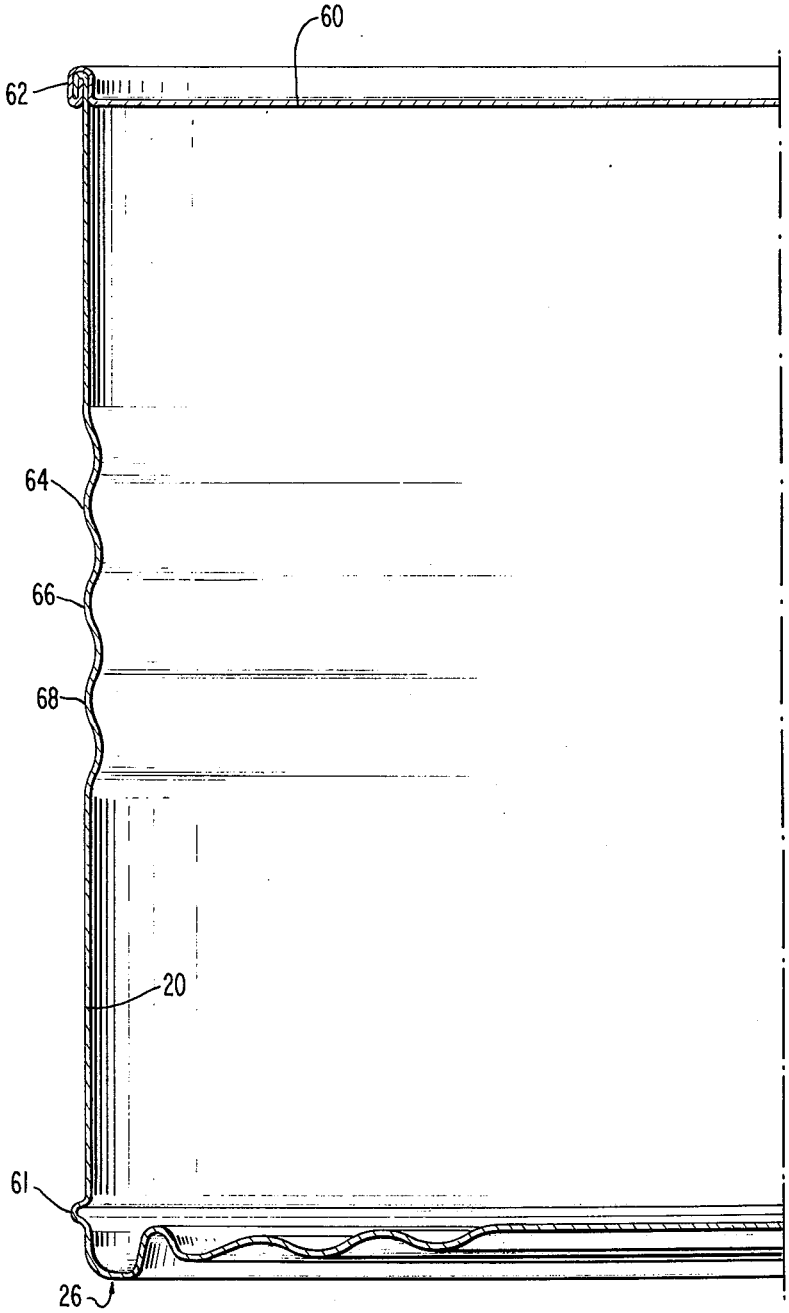

Other features and contributions of the invention are described in more detail in relation to the accompanying drawings, in which:

FIG. 1 is a cross-sectional view of a portion of a can body with a prior art bottom profile, FIG. 2 is a schematic cross-sectional view of a portion of a can body showing the increased strength seamless chime juncture of the present invention, FIG. 3 is a partial view, in cross-section, of tooling used to form the seamless chime juncture and bottom wall profile of the present invention, FIG. 4 is a radial cross-sectional view of a portion of a can body showing the seamless chime juncture and endwall resulting from use of the tooling of FIG. 3, and FIG. 5 is a radial cross-sectional view of a can body, shown in part, embodying the present invention.

A shallow-depth drawn can body for low vacuum and pressure uses can be made by impressing a conventional reinforcing ring profile in an endwall as shown in FIG. 1. In such profile, bottom wall 10 is disposed in substantially right angled relationship to sidewall 12. Bottom wall 10 includes a centrally located panel 14 and, generally, two or more curvilinear configuration reinforcing ring impressions, such as 15,16, circumscribing the planar panel 14.

While the configuration of FIG. 1 may be adequate for shallow-depth, low-vacuum pack contents, in order to provide adequate strength for higher vacuum pack foodstuffs, a substantially heavier gage sheet metal than that now found economical for can bodies would be required. Also, while a heavy gage sheet metal material, in the configuration of FIG. 1, could provide protection against explosive type buckling, the chime area 18 would be dent prone and, considering only normal handling, implosion is likely due to the higher internal vacuum required for most foodstuffs.

An important feature of the present invention is a chime configuration for a seamless can body which presents adequate strength for sanitary can backs using sheet metal gages equal to or less than those conventionally used for three-piece cans. A seamless chime juncture is provided which contributes a flexible endwall feature, affording a "diaphragm" type flexing action of the endwall, which permits vacuum or pressure conditions to be withstood without permanent distortion of chime juncture or endwall sheet metal. Such chime juncture also furnishes improved hoop strength and dent-proof characteristics to enable normal handling without permanent deformation of the can body sheet metal.

Referring to FIG. 2, a portion of a drawn can body is shown with portions of sidewall 20 and endwall 22 presented in dotted lines. Sidewall 20 is parallel to a longitudinally extended center line axis 24. A seam-free chime 26, as taught by the present invention is shown in solid lines.

Seamless chime 26 comprises a plurality of longitudinally-oriented sheet metal wall portions in radially spaced relationship; these include an outer wall 28 at the lower end of sidewall 20, an intermediate wall 30, and an inner wall 32.

The outer wall 28 is joined to the intermediate wall 30 as to form a channel 34 having a U-shaped configuration in radial cross-section. The U-shaped configuration opens toward the interior of the can body. Apex 36 is at the bottom of the U-shaped outer channel 34.

The inner wall 32 is joined to the intermediate wall 30 as to form a channel 38 of U-shaped configuration in radial cross-section. Such inner channel 38 opens externally of the can body. Channel 38 defines apex 40 at the closed end of its U-shaped configuration.

In manufacture of a can body in accordance with the invention, a cup-shaped article is drawn with slightly greater sidewall length than would be required conventionally; for example a 4 inches (10.16 cm) height can body is drawn to a length of approximately 4-1/6 inches (approx. 10.23 cm). This additional sidewall length compensates for the metal used in forming the seamless chime juncture for containers of prescribed height requirements.

Tooling to carry out the invention is shown in open juxtaposition in FIG. 3. Drawn can body 42 is mounted on mandrel 44 which interfits with tool 46 to form the configuration at the chime juncture and bottom wall profile shown in FIG. 4. Segment 48 of mandrel 44 is adjustable in height and can be adjustably received by tool 46 to vary the length of the leg 32 and the longitudinal positioning of the remainder of the endwall panel.

As better seen in FIG. 4, channel 34 and 38 comprise circular channels which extend around the full circumferences of their respective diameters presenting a toroidal configuration when viewed axially. This double-channel reinforced chime juncture is able to withstand corner impact of normal handling without denting and, is able to withstand internal vacuum or pressure conditions without permanent distortion of chime or endwall configurations.

Endwall panel 22, which includes planar disc 50 and reinforcing rings 52,54, is able to flex inwardly and outwardly, with its center moving longitudinally along longitudinal axis 24 as indicated by arrows 56,58. This flexing action is made possible in large part due to a pivoting action about apex 40 of channel 38. Inner wall 32 has a spring-like action and moves slightly out of its longitudinal orientation at its lower end, toward and away from the central longitudinal axis 24, because of the pivoting action about apex 40 as the endwall 22 panel flexes. With internal vacuum, endwall panel 22 at planar disc 50 moves in the direction of arrow 56 and wall 32 is drawn toward axis 24. With internal pressure, endwall panel 22 at disc 50 moves in the direction of arrow 58 with wall 32 being urged away from axis 24 as planar disc 50 moves through its median point. This diaphragm-like action takes place without permanent distortion of chime juncture 26 or its contiguous structure.

Such flexing action is facilitated largely by the orientation of the inner wall 32 which is formed to return longitudinally from apex 40 toward the plane which includes apex 36 of channel 34. The major directional component of wall 32, as shown in radial cross-section is longitudinal. The desired flexing action about the pivot point represented by apex 40 would not be available if the major directional component of wall 32 were lateral, i.e. toward the central longitudinal axis 24 from apex 40. It should be noted that inner wall 32 returns a major portion of the longitudinal distance between apex 36 and apex 40. The amount of return of wall 32 can be varied by adjustable portions of the tooling of FIG. 3. However, the length of inner wall 32 is selected to be at least half the length of intermediate wall 30.

The spring-like action of inner wall 32 provided by the invention prevents permanent distortion of intermediate wall 30. The structural integrity thus maintained in channel 34 provides dent-proof characteristics at the bottom edge of the can body which would not otherwise be available.

Further, endwall panel 22 is provided with reinforcing profiling, such as rings 52,54, which add to its strength and help facilitate the flexing action. These advantages are afforded without significant sacrifice of container capacity.

Provision also is made for the added diameter of the double seam conventionally used for securing an endwall closure to the open end of the can body. In the manufacture of two-piece beverage containers, the problem of differing top and bottom diameters is solved by necking-in the top edge of the seamless can body to accommodate the added diameter of the top closure chime seam. However many sanitary cans are used for semi-solid materials, for example gels, where a restriction in diameter at the end of the can which is opened would not be desirable.

In FIG. 5, endwall closure 60 has been added to a seamless can body. In order to accommodate the added diameter of double seam 62, to provide a can which will roll in a straight line, and to accommodate labelling, a bead 64 is roll formed in the sidewall contiguous to the seamless chime juncture 26. Sidewall bead 64 extends 62. outwardly from sidewall 20 a distance equal to the increased diamedral dimension presented by endwall closure double seam 62,.

In order to strengthen the sidewall 20 of the container of FIG. 5, i.e. provide protection against vacuum implosion of the sidewall, reinforcing ribs 64,66,68 are roll formed in the sidewall. These permit use of lighter gage material, especially for extended height cans.

In practice of the invention, typical thickness gages for standard commercial can sized would be as follows:

| | Steel | Aluminum |
|---|---|---|
| sidewall | .006" to .012" (.152 mm to .304 mm) | .007" to .015" (.176 mm to .381 mm) |
| endwall | .006" to .012" (.152 mm to .304 mm) | .007" to .015" (.176 mm to .381 mm) |
| closure endwall | .008" to .011" (.203 mm to .279 mm) | .010" to .013" (.254 mm to .330 mm) |

In the manufacture of a 3.33 inches (8.33 cm) diameter can body, intermediate wall 30 would have a diameter of approximately 3.07 inches (7.79 cm), inner wall 32 would have a diameter of about 2.9 inches (7.36 cm), and reinforcing ribs 52 and 54 would have centerline diameters of approximately 2.28 inches (5.79 cm) and 1.77 inches (4.49 cm) respectively. The distance longitudinally between apex 36 and apex 40 would be approximately 0.1 inches (0.25 cm). Inner wall 32 returns longitudinally toward the plane of apex 36 approximately 0.06 inches (0.15 cm).

In the light of the present teachings, other gages, materials, and dimensions are readily available to those skilled in the art without departing from the inventive concept, therefore the scope of the invention should be determined from the appended claims.

What is claimed is:

1. Sheet metal can body having a seamfree sidewall symmetrically spaced from a central longitudinal axis defining an open end and having a unitary endwall joined to the sidewall at its remaining opposite longitudinal end by a seam-free reinforced chime juncture, such can body being for use in a sealed two-piece can in which the reinforced chime juncture and unitary endwall are able to withstand both vacuum packing and the internal pressure of food processing without permanent distortion, such reinforced chime juncture comprising channel means disposed about a peripheral portion of the can body endwall contiguous to the sidewall, such channel means including an outer channel, and an inner channel contiguous to and radially inward of the outer channel, each such channel opening in a longitudinal direction to present a toroidal configuration when viewed axially, such channels being defined by a plurality of wall portions of such can body sheet metal disposed in radially spaced relationship to each other and with the major directional component of each wall portion being longitudinal of the can body, such plurality of wall portions including an outer wall, an intermediate wall, and an inner wall, the outer wall comprising a portion of the sidewall contiguous to the endwall, the intermediate wall being located radially inwardly of and joined to the outer wall so as to define with the outer wall such outer channel, the outer channel having a U-shaped configuration in radial cross-section with such U-shaped configuration opening toward the interior of the can body, the inner wall being disposed radially inwardly of and joined to the intermediate wall so as to define with the intermediate wall such inner channel, such inner wall extending longitudinally a dimension equal to at least half that of a corresponding longitudinal dimension of the intermediate wall, the inner channel having a U-shaped configuration in radial cross section with such U-shaped configuration opening toward the exterior of the can body and defining an apex at its closed end, the unitary endwall including a panel portion extending laterally from such inner wall toward the central longitudinal axis, such endwall panel including a centrally located substantially planar disc circumscribed by at least one reinforcing ring profile means, such endwall panel being capable of flexing to enable longitudinal movement of its central point along the central longitudinal axis, with such flexing action changing the longitudinal orientation of the inner wall about the apex of the inner channel such that the inner wall at its longitudinal end opposite to such apex can be moved in a radial direction without permanent distortion of chime juncture and contiguous sheet metal.

2. The can body of claim 1 further including a sheet metal endwall closure for the open longitudinal end defined by the sidewall, such closure being joined to the sidewall by a chime seam having a diameter greater than that of the can body sidewall, and bead means formed in the sidewall contiguous to the seamless chime juncture, such bead means having a diameter approximately equal to that of the chime seam joining such closure to the sidewall.

3. The can body of claim 2 further including reinforcing rib means formed in the sidewall and located longitudinally intermediate the bead means and such endwall closure seam.

* * * * *

UNITED STATES PATENT OFFICE

CERTIFICATE OF CORRECTION

Patent No. 4,120,419 Dated October 17, 1978

Inventor(s) William T. Saunders

It is certified that error appears in the above-identified patent and that said Letters Patent are hereby corrected as shown below:

In the ABSTRACT, line 11, "interval" should read --internal--.

Column 1, line 26, "0.009inch" should read --0.009 inch--.

Column 2, line 57, "inches" should read --inch--.

Column 4, line 7, "62." should read --radially--;
line 9, after "62", delete the comma (,);
line 27, "3.33 inches" should read --3.23 inch--;
line 33, "inches" should read --inch--;
line 35, "inches" should read --inch--;
line 37, "inches" should read --inch--;
line 44, "seamfree" should read --seam-free--.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*